US011719242B2

(12) United States Patent
Welte et al.

(10) Patent No.: US 11,719,242 B2
(45) Date of Patent: Aug. 8, 2023

(54) AXIAL PRESSURE RELIEF IN SLIDE BEARINGS OF PUMPS

(71) Applicant: Schwäbische Hüttenwerke Automotive GmbH, Aalen-Wasseralfingen (DE)

(72) Inventors: Claus Welte, Aulendorf (DE); Uwe Meinig, Bad Saulgau (DE)

(73) Assignee: Schwäbische Hüttenwerke Automotive GmbH, Aalen (DE)

( * ) Notice: Subject to any disclaimer, the term of this patent is extended or adjusted under 35 U.S.C. 154(b) by 0 days.

(21) Appl. No.: 17/355,553

(22) Filed: Jun. 23, 2021

(65) Prior Publication Data

US 2021/0404470 A1 Dec. 30, 2021

(30) Foreign Application Priority Data

Jun. 25, 2020 (DE) ..... 10 2020 116 822.5

(51) Int. Cl.
*F04C 29/00* (2006.01)
*F04C 2/344* (2006.01)
*F04C 27/00* (2006.01)

(52) U.S. Cl.
CPC ..... *F04C 29/0028* (2013.01); *F04C 2/344* (2013.01); *F04C 27/009* (2013.01); *F04C 29/0035* (2013.01); *F04C 2240/30* (2013.01); *F04C 2240/50* (2013.01); *F04C 2240/56* (2013.01); *F04C 2240/60* (2013.01); *F04C 2240/603* (2013.01)

(58) Field of Classification Search
CPC ..... F04C 29/0028; F04C 27/009; F04C 2240/30; F04C 2240/50; F04C 2240/56; F04C 2240/60; F04C 2240/603
See application file for complete search history.

(56) References Cited

U.S. PATENT DOCUMENTS 8,419,392 B2 4/2013 Yamamuro et al.
9,599,108 B2 3/2017 Khanzode et al.
(Continued)

FOREIGN PATENT DOCUMENTS

CN 101260882 A 9/2008
CN 106168215 A 11/2016
(Continued)

OTHER PUBLICATIONS

Extended European Search Report issued in European Patent Application No. 21174344.8, dated Oct. 18, 2021 with machine translation, 15 pages.
(Continued)

*Primary Examiner* — Mary Davis
(74) *Attorney, Agent, or Firm* — RatnerPrestia

(57) ABSTRACT

A pump is described, including: a drive shaft including a rotor; a first housing part and a second housing part, between which a pump chamber is formed, in which the rotor is arranged; a rotary bearing via which the drive shaft is mounted on the first housing part such that it can rotate about its rotational axis; and a passage including a first opening and a second opening, wherein the rotary bearing is arranged between the pump chamber and the first opening, and the second opening of the passage emerges onto the side of the second housing part which faces away from the pump chamber.

16 Claims, 1 Drawing Sheet

(56) References Cited

U.S. PATENT DOCUMENTS

| | | | | |
|---|---|---|---|---|
| 10,060,432 | B2 | 8/2018 | Pippes et al. | |
| 10,082,139 | B2 * | 9/2018 | Welte | F04C 14/02 |
| 2016/0377077 | A1 | 12/2016 | Khanzode et al. | |
| 2021/0115921 | A1 * | 4/2021 | Forster | F04C 11/00 |
| 2021/0164460 | A1 | 6/2021 | Bauer et al. | |

FOREIGN PATENT DOCUMENTS

| | | | | | |
|---|---|---|---|---|---|
| CN | 106286285 | A | | 1/2017 | |
| CN | 106704198 | A | | 5/2017 | |
| CN | 111089050 | A | * | 5/2020 | |
| DE | 19952167 | A1 | | 6/2000 | |
| DE | 102016210821 | A1 | | 12/2016 | |
| DE | 102016213611 | A1 | | 1/2018 | |
| DE | 102016121241 | A1 | * | 5/2018 | F04C 2/344 |
| DE | 102016121241 | A1 | | 5/2018 | |
| EP | 2921702 | A2 | | 9/2015 | |
| EP | 3832175 | A1 | | 6/2021 | |

OTHER PUBLICATIONS

Chinese Office Action for Chinese Application No. 202110697503.9, dated Nov. 30, 2022 with translation, 20 pages.

* cited by examiner

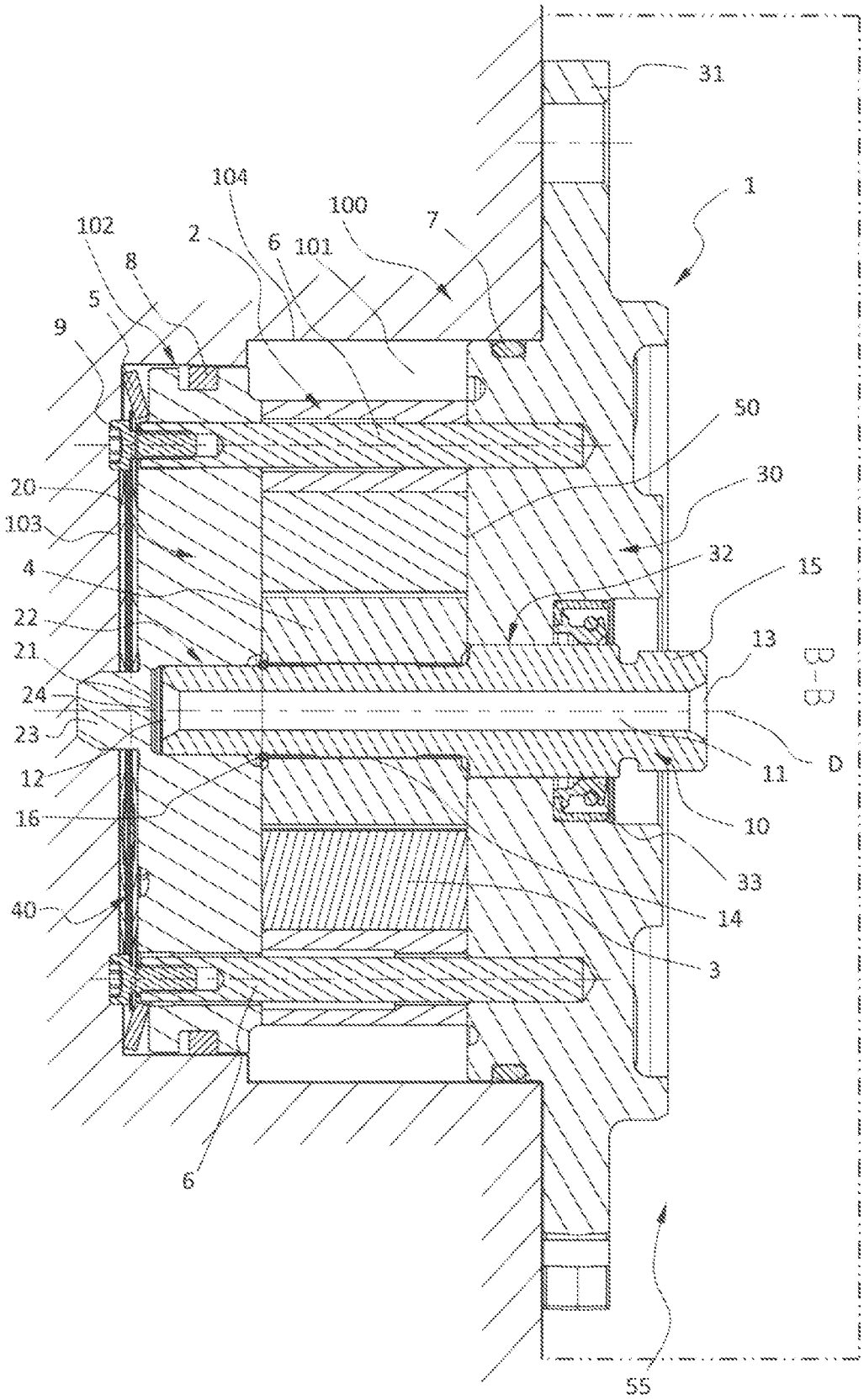
31
1
104
100
7
102
2
6
101
8
5
9
50
30
20
103
32
4
15
22
13
21
24
23
D
12
11
16
10
33
40
14
3
6
55

AXIAL PRESSURE RELIEF IN SLIDE BEARINGS OF PUMPS

CROSS REFERENCE TO RELATED APPLICATIONS

This applications claims benefit of priority to German Patent Application No. 10 2020 116 822.5, filed Jun. 25, 2020. The contents of this application are incorporated herein by reference.

FIELD OF THE INVENTION

The invention relates to axial pressure relief in slide bearings of pumps, in particular oil pumps, via a passage in the pump housing and/or in the pump shaft or drive shaft, wherein said passage can for example be embodied as a central bore in the pump shaft or drive shaft. The invention also relates to a pump, such as for example a lubricating oil pump, coolant pump, gear pump or vacuum pump, comprising such a device for relieving pressure. The pump can be a single-flux or multi-flux pump and/or can be a single-stroke or multi-stroke pump, in particular a single-circuit or multi-circuit pump. It can be used as a gear pump for supplying a gearbox, for example an automatic gearbox or steering gearbox of a vehicle or a gearbox of a wind turbine, with pressure fluid. In another application, it can be used as a lubricant pump and/or coolant pump for supplying a combustion engine, for example a drive motor of a vehicle, with lubricant and/or coolant, in particular lubricating oil. It is equally conceivable to use it as a combined lubricating oil pump and gear pump, in particular in embodiments in which the pump is a multi-flux pump. The pump can advantageously be embodied as a so-called cartridge. It can therefore comprise a pump insert which is or can be inserted as a unit into an accommodating space formed by an accommodating housing. The pump can also be used to lubricate and/or cool an electric motor which for example forms a drive motor or auxiliary drive motor of a motor vehicle.

BACKGROUND OF THE INVENTION

In the case of oil pumps and specifically dual-stroke vane cell pumps, for example for being installed in automatic and dual-clutch gearboxes, the pump shaft is multiply mounted via slide bearings, from a viewpoint of installation space and cost. In such slide bearings, depending on the bearing loads prevailing during operation, the shaft can be mounted with no additional bearing socket using the material of the bearing bore or, at high bearing loads with the risk of mixed friction during operation, with a separate bearing socket made of a bearing material suitable for the present case. In particular in pumps which deliver at a higher pressure level of several tens of bars and in which the pump shaft does not protrude out of the pump housing into the open on both sides, particular demands on the structural design of the pump arise from the fact that, because the end-facing surfaces of the drive shaft and the rotating assembly to which the operating pressure of the pump is applied differ from each other, a substantial axial thrust arises which has to be absorbed by the pump shaft or the pump rotor, depending on the axial mounting design selected. This axial thrust generates a frictional torque which can cause wear on the corresponding supporting surfaces and also increases the drive output of the pump and therefore reduces the efficiency of the pump. In order to minimize the axial thrust onto the end-facing surface of the pump shaft to which the operating pressure is applied, it is usual to connect the bearing bore of the pump shaft, which is embodied as a blind hole and faces away from the drive side, to the suction region of the pump via a relief bore which is for example oblique. One disadvantage of this solution is that the relief bore, which emerges obliquely into the slide bearing, produces an intersection geometry which can be deburred only at considerable effort in large-scale production and which runs the risk—despite a relatively elaborate deburring process, for example by means of a spherical milling tool—of burrs being folded over or of new burrs being formed which can become detached over the period of operation of the pump and cause malfunctions in the oil circulation and/or in the control block of the gearbox. Since the direction of the resultant radial forces, which are to be supported by said slide bearing, can vary significantly during operation, in particular in dual-circuit pumps, the load-bearing capacity of the bearing is also in practice reduced by said pressure relief bore which leads to the suction region, since a substantial accumulation of pressure is hardly possible in the region around the intersection geometry, which is shaped as a cylindrical shell and comprises the relief bore, and also the structural and/or machining degrees of freedom for determining the physically optimum angular positioning of the point at which the relief bore emerges into the slide bearing are generally limited.

German patent application No. 10 2019 132 729.6, incorporated herein by reference, discloses a pump comprising a drive shaft, wherein the end of the drive shaft facing away from the drive side is arranged in a bearing bore (embodied as a blind hole) of a housing part which is embodied as a pressure plate. The drive shaft is mounted on the pressure plate by means of slide bearings. An intermediate space is formed between a wall formed by the pressure plate (the base of the blind hole) and the end of the drive shaft mounted in the pressure plate. When the pump is in operation—and if pressure relief is not provided for said intermediate space—pressure cam accumulate in the intermediate space, thereby exerting an axial thrust on the drive shaft.

SUMMARY OF THE INVENTION

An aspect of the invention is a cost-effective pump which is easy to manufacture in large-scale production and which reduces or avoids axial thrust of the pump shaft during operation.

An aspect of the invention is based on a pump, in particular a vane cell pump. The pump can be embodied as a cartridge pump. A pump insert can accordingly be inserted or able to be inserted as a unit into an accommodating space which is formed by an accommodating housing and which is for example cup-shaped.

The pump comprises a drive shaft which can also be referred to as a pump shaft, comprising a rotor. The rotor can be formed by the drive shaft or, as is preferred, joined to the drive shaft such that it is rotationally fixed about the rotational axis of the drive shaft, for example by means of a shaft-hub connection. Rotating the drive shaft about its rotational axis thus causes the rotor to rotate about the rotational axis.

The pump also comprises a first housing part and a second housing part, between which a pump chamber is formed, in which the rotor is arranged. The first housing part and the second housing part define the pump chamber in the direction of the rotational axis. The first housing part can for example be embodied as a pressure plate which in particular comprises at least one outlet channel or in which at least one outlet channel is formed. The second housing part can for example be embodied as a fitting plate which can be or is fastened to an accommodating housing. The second housing part and/or the fitting plate can comprise a fastening device, in particular a fastening flange, for fastening the second housing part to the accommodating housing. The fastening flange, or the second housing part in general, can for example be fastened or screwed to the accommodating housing by means of at least one stud-bolt. The fastening flange can for example be clamped between a head of the stud-bolt and the accommodating housing.

The pump chamber can be surrounded on its circumferential side by a contour ring. In particular, an inner circumferential surface of the contour ring can form an inner contour and define the pump chamber on its circumferential side. The contour ring can be enclosed as a separate part between the first and second housing parts. Optionally, the contour ring can be formed in one piece with either the first housing part or the second housing part.

The rotor can comprise cavities, in particular guides such as for example slot-shaped cavities or guides, in which delivery elements such as for example vanes, slides or rollers are accommodated such that they can be moved, in particular shifted, radially with respect to the rotational axis. The delivery elements are accommodated or mounted by the rotor in such a way that they rotate together with the rotor about its rotational axis. In particular, each of the delivery elements is mounted such that it can be shifted in one translational degree of freedom via its guide.

The first housing part, the second housing part and the contour ring can thus enclose and/or define a pump chamber in which the rotor and the delivery elements are arranged. At least one delivery chamber, such as for example a first delivery chamber and a second delivery chamber in the case of a dual-stroke or dual-flux pump, can be formed radially between the contour ring and the rotor which is rotatably enclosed between the first and the second housing parts.

A delivery cell which is formed between respectively adjacent delivery elements is defined on its circumferential side by the inner circumferential surface of the contour ring and in the direction of the rotational axis by the first housing part on one side and by the second housing part on the other side, and its volume changes depending on the rotational position of the rotor around its rotational axis. The pump comprises a multitude of delivery elements and therefore a multitude, and in particular an identical number, of delivery cells which are formed between the delivery elements.

The inner circumference of the contour ring comprises a contour along which the delivery elements slide when the rotor rotates. The contour is in particular embodied such that the volumes of the delivery cells moving through the delivery chamber due to the rotation of the rotor initially increase and then decrease. In a complete revolution of the rotor, the delivery elements are moved away from the rotational axis and towards the rotational axis at least once. The pump can for example be a dual-stroke and/or dual-flux pump, i.e. it can be embodied so as to comprise a first delivery chamber and a second delivery chamber through which the delivery elements and/or delivery cells pass once for each complete revolution. This means that the delivery elements are alternately moved away from the rotational axis twice and towards the rotational axis twice during a complete revolution. During a rotation of the rotor, a delivery cell initially increases in volume and then decreases in volume.

The pump or the pump insert can comprise at least one inlet channel which emerges into the region of the delivery chamber in which the delivery cell increases in volume, and at least one outlet channel which emerges into the region of the delivery chamber in which said delivery cell decreases in volume. Due to the increase in the volume of the delivery cell, the at least one inlet channel acts as a suction channel. Due to the decrease in volume, the at least one outlet channel acts as a pressure channel. A single-stroke pump can for example comprise one inlet channel and one outlet channel. A dual-stroke or dual-flux pump can for example comprise a common inlet channel for the first and second delivery chambers, a first outlet channel for the first delivery chamber, and a second outlet channel (which is separate from the first outlet channel) for the second delivery chamber. In one alternative, the pump insert can comprise a first inlet channel for the first delivery chamber, a second inlet channel (separate from the first inlet channel) for the second delivery chamber, and a first outlet channel for the first delivery chamber and a second outlet channel (separate from the first outlet channel) for the second delivery chamber or a common outlet channel for the first and second delivery chambers. The fluid delivered via the first delivery chamber can for example be supplied to different consumers or the same consumers as the fluid delivered via the second delivery chamber. If different consumers are supplied, different pressure levels can arise between the first outlet channel and the second outlet channel and/or between a first pressure space, into which the first outlet channel emerges, and a second pressure space into which the second outlet channel emerges. The delivery elements and/or the rotor each form a sealing gap with the first housing part and the second housing part. The at least one inlet channel can be connected to and in particular in fluid communication with a fluid reservoir, such as for example an oil tank. The at least one suction channel can for example emerge into a suction space which can for example be formed between the accommodating housing and the pump insert, in particular between an inner circumferential wall of the accommodating housing and the pump insert, such as for example the contour ring. The at least one outlet channel can be connected to at least one fluid consumer, such as for example in fluid communication with a gearbox. The at least one outlet channel, in particular the at least two outlet channels, is/are preferably formed in the first housing part. The at least one outlet channel, in particular the at least two outlet channels, advantageously emerge(s) via an opening, in particular via one opening each, onto the side of the first housing part which faces away from the pump chamber.

The pump can comprise a rotary bearing, in particular a slide bearing, via which the drive shaft is mounted on the first housing part such that it can rotate about its rotational axis. The slide bearing can in particular be formed by the first housing part or by a bearing socket introduced into the first housing part. Optionally, a second rotary bearing can be provided, via which the drive shaft is mounted on the second housing part such that it can rotate about its rotational axis. The second rotary bearing which is embodied as a slide bearing can for example be formed by the second housing part or by a bearing socket introduced into the second housing part.

In embodiments, the drive shaft can comprise a passage, in particular an elongated passage, which extends along the rotational axis of the drive shaft. The passage can for example be embodied as a bore. The passage comprises a first opening and a second opening. The first rotary bearing is arranged between the pump chamber and the first opening. The first rotary bearing is preferably arranged or formed between an end of the drive shaft arranged in the first housing part and the pump chamber. This means that pressure cannot accumulate in front of the first opening and/or in front of the end of the drive shaft arranged in the first housing part, since it is relieved via the passage. Fluid or so-called leakage fluid can for example flow from the pump chamber into the region, in particular a hollow space or gap, in front of first opening via the first rotary bearing, whereby—if the shaft did not comprise a passage—pressure could accumulate. The leakage fluid can be drained and/or the pressure can be relieved through the passage.

In alternative embodiments, at least one of the first housing part, the second housing part, the contour ring or a positioning element using which the first housing part and the second housing part and optionally the contour ring can be positioned relative to each other around the rotational axis of the drive shaft can comprise a passage or part of a passage. The first housing part can for example comprise the first opening, and the second housing part or the positioning element can comprise the second opening. The first opening can emerge into a region, in particular a hollow space or gap, arranged in front of the end of the drive shaft which is arranged in the first housing part. Fluid or so-called leakage fluid can for example flow from the pump chamber into the region, in particular the hollow space or gap, via the first rotary bearing, whereby—without a passage for relieving pressure—pressure could accumulate. The leakage fluid can be drained and/or the pressure can be relieved through the passage.

The passage is preferably embodied as a relief passage or relief channel. Preferably, the first opening of the passage is fluidically connected to the region, in particular the hollow space or gap, arranged in front of the end of the drive shaft which is arranged in the first housing part. The first opening is in particular formed in the drive shaft at an end of the drive shaft which is arranged in the first housing part.

The second opening of the passage can for example emerge onto the side of the second housing part which faces away from the pump chamber. Leakage fluid can thus be drained onto the side of the second housing part which faces away from the pump chamber. Alternatively or additionally, the second opening of the passage can emerge into a relief space or into the environment of the pump or into the environment of a pump insert which is situated outside an accommodating space of an accommodating housing. The pump insert can be arranged in the accommodating space, in particular when the pump is embodied as a cartridge. Preferably, the second opening of the passage is fluidically connected to the relief space or to the environment of the pump or pump insert. The pump shaft or drive shaft advantageously protrudes axially out of the second housing part. The second opening is in particular formed in the drive shaft at an end of the drive shaft which protrudes axially out of the second housing part.

The passage preferably extends from its first opening to its second opening. The first rotary bearing and/or the second rotary bearing are advantageously arranged axially between the first opening and the second opening of the passage. The pump chamber is preferably arranged axially between the first opening and the second opening of the passage.

The pump can for example comprise a hollow space, for example a gap-shaped, cylindrical or conical hollow space, between a base of a blind hole formed by the first housing part and the first end of the drive shaft which is arranged in the first housing part, in particular in the blind hole. The first opening of the passage emerges into the hollow space. The first housing part, in particular the at least one inner surface of the blind hole, can thus enclose and define the hollow space on its circumferential and/or end-facing side. The first end of the drive shaft can also define the hollow space. The base of the blind hole can for example be embodied as a flat or conical surface. The base and the first end of the drive shaft point towards each other.

The first rotary bearing is preferably arranged between the pump chamber and the hollow space. Leakage fluid which flows from the pump chamber into the hollow space via the first rotary bearing can thus be drained via the first opening, the passage and in particular the second opening. It is thus possible to prevent axial thrust from being exerted on the drive shaft due to pressure accumulating in the hollow space.

The passage thus serves as a pressure relief channel. As mentioned, the passage which is embodied as a bore, in particular a centrally arranged bore, can be embodied in the drive shaft. The passage can for example be embodied so as to be graduated one or more times with regard to its diameter from the one end to the other end.

In developments, the drive shaft can comprise a connecting structure, which is for example arranged in the relief space or in the environment of the pump or pump insert, on the side of the second housing part which faces away from the pump chamber, wherein the connecting structure is adapted to be connected to a corresponding complementary structure of a hub in order to form a shaft-hub connection. A drive element, which comprises a corresponding hub and is arranged for example in the relief space or in the environment of the pump or pump insert, can advantageously be attached to the connecting structure. The drive element can for example be a gear wheel, a pinion, a belt disc or a gear element of for example a planetary gear system. A gear element of a planetary gear system can for example be a planetary carrier, a sun wheel or a hollow wheel. The hub and/or the drive element can be connected to the drive shaft such that it is rotationally fixed about the rotational axis of the drive shaft, for example by means of the shaft-hub connection. Rotating the drive element about its rotational axis thus causes the drive shaft to rotate about the rotational axis.

Optionally, one or more channels, in particular bores, which extend transversely or radially with respect to the rotational axis or longitudinal direction of the passage and which relieve pressure equalization and/or lubricate a shaft-hub connection, emerge into the passage which extends along the rotational axis in the drive shaft.

The pump, in particular the drive shaft, can for example be embodied such that fluid drained via the passage is guided onto the shaft-hub connection to which the hub of the drive element and the drive shaft are or can be joined, in particular on the drive side. This enables the shaft-hub connection to be lubricated, in order to prevent wear or fretting at the shaft-hub connection. The drive shaft can for example be embodied such that the fluid which is drained via the passage, in particular while the pump is in operation, can be delivered onto the connecting structure, in particular between the connecting structure and the hub. The drive shaft can comprise one or more bores which are arranged transversely with respect to the rotational axis or the longitudinal direction of the passage and which emerge into the passage and the connecting structure, thus enabling fluid to be guided from the passage onto the connecting structure via the at least one transverse bore.

In developments, the drive shaft can be embodied such that fluid or leakage fluid drained via the passage can be guided onto the shaft-hub connection between the drive shaft and the rotor. The drive shaft can for example comprise one or more bores which are arranged transversely with respect to the rotational axis or the longitudinal direction of the passage and through which fluid drained via the passage can be guided into the shaft-hub connection. The at least one bore can for example emerge into the passage and into the shaft-hub connection. This enables the shaft-hub connection to be lubricated and wear and/or fretting to be prevented.

In developments, the drive shaft can comprise one or more bores which are arranged transversely with respect to the rotational axis or longitudinal direction of the passage and which emerge onto the outer circumference of the drive shaft and onto the passage. The at least one bore can for example emerge into a region on the outer circumference of the drive shaft which is arranged between the pump chamber and a shaft gasket, in particular a radial shaft sealing ring, or between the rotor and the shaft gasket. The second rotary bearing can for example be arranged between the shaft gasket, in particular a radial shaft sealing ring, and the pump chamber. The shaft gasket can for example be arranged between the second rotary bearing or the pump chamber on the one hand and the environment or the relief space or the connecting structure on the other. It is thus possible to seal off the pump chamber and/or the second rotary bearing in relation to the environment or the relief space. In particular, the bore can emerge into a region on the outer circumference of the drive shaft which is arranged between the shaft gasket and the second rotary bearing. The bore which emerges into the region between the rotor or the pump chamber and the shaft gasket enables pressure to be relieved, in order to relieve the radial shaft sealing ring and thus reduce wear on the radial shaft sealing ring. In order that this bore does not impair or annul the sealing effect of the shaft gasket, a siphon or siphon structure or the like can for example be formed. The shaft gasket is preferably arranged axially between the first opening and the second opening of the passage, in particular axially between the second rotary bearing and the second opening of the passage.

The relief space can for example be formed, or the environment of the pump or pump insert can for example be arranged, on the side of the second housing part which faces away from the pump chamber, wherein the relief space and/or the environment is adapted to accommodate the drive element and/or its hub to which the connecting structure can be connected.

The bore which emerges onto the connecting structure can for example be the second opening. Preferably, however, the second opening emerges onto a second end of the drive shaft, i.e. onto the end-facing side of the drive shaft which forms the second end. The at least one transverse bore, described further above, can be provided in addition to the second opening.

In embodiments, the relief space or the environment can be connected to a reservoir or to the suction side, in particular a suction space of the pump, in order to feed fluid back from the relief space or the environment. For this purpose, a channel can for example be provided which leads from the relief space or the environment to the reservoir or suction space. It is also preferred if the relief space or the environment is connected, with pressure equalization, to the atmosphere in which the pump is operated, such that atmospheric pressure or substantially atmospheric pressure prevails in the relief space or the environment while the pump is in operation.

The pump can for example comprise a pump insert which comprises at least the drive shaft, together with the rotor, and the first housing part and the second housing part and preferably also the contour ring. The pump insert can be inserted as a unit into the accommodating space, which is for example a cup-shaped accommodating space, formed by the accommodating housing.

A gearbox can for example comprise the pump in accordance with an aspect of the invention. The gearbox can comprise a gear housing and/or the accommodating housing. The gear housing can for example form the accommodating housing. The gear housing can form or enclose the relief space or the environment of the pump or pump insert. The relief space or the environment can thus be surrounded by the gear housing. The hollow space can thus be relieved of pressure via the passage into the space surrounded by the gear housing, i.e. the relief space or the environment. A reservoir, in particular an oil sump, into which the fluid which can be drained through the passage can be drained, can be formed on or in the gear housing. The gearbox or the gear housing can for example comprise a venting device which equalizes pressure between the atmosphere and the space surrounded by the gear housing. The gearbox can for example comprise a gear shaft which is connected to the drive shaft of the pump via the drive element, such that rotating the gear shaft causes the drive shaft to rotate.

The pump can for example comprise a sealing element which is arranged between the pump insert, in particular the second housing part, and the accommodating housing and seals off the accommodating space, in particular a suction space of the pump, in relation to the environment and/or the relief space. This sealing element is preferably arranged axially between the first opening and the second opening of the passage.

As already described, the pump can be a dual-stroke pump, in particular a dual-flux pump. The first working flux can be delivered via a first pressure space, and the second working flux can be delivered via a second pressure space. For this purpose, the pump chamber—in particular, a first delivery chamber—can be connected to the first pressure space via a first outlet channel, and the pump chamber—in particular, a second delivery chamber—can be connected to the second pressure space via a second outlet channel, wherein the first pressure space and the second pressure space are sealed off in relation to each other. A gasket can for example be provided which seals off the first pressure space and the second pressure space from each other. The gasket can for example be arranged between an end-facing wall of the accommodating space, which is for example cup-shaped and is formed by the accommodating housing, and the first housing part. A gasket can for example be provided which surrounds the first pressure space, and a second gasket can be provided which surrounds the second pressure space. The accommodating housing can comprise a drainage channel for the first working flux and a drainage channel for the second working flux. The first drainage channel can emerge into the first pressure space, and the second drainage channel can emerge into the second pressure space.

In other embodiments, the first pressure space and/or the second pressure space can be formed between the end-facing wall of the accommodating space and the first housing part. Alternatively or additionally, the suction space can be formed between the inner circumferential wall of the accommodating space and the pump insert or the contour ring of the pump insert.

The pump can for example comprise a sealing element which is arranged between the pump insert, in particular the first housing part, and the accommodating housing and seals off the suction space in relation to the pressure space(s). This sealing element is preferably arranged axially between the first opening and the second opening of the passage.

BRIEF DESCRIPTION OF THE DRAWINGS

The invention has been described on the basis of embodiments and examples. An embodiment will now be described on the basis of a FIGURE. The features thus disclosed, each individually and in any combination of features, advantageously develop the subject-matter of the claims. The FIGURE shows a section through a pump insert 1, which is inserted into an accommodating housing 100, along the rotational axis D of a drive shaft 10.

DETAILED DESCRIPTION OF THE INVENTION

The pump insert 1 comprises a first housing part 20, which is embodied as a pressure plate, and a second housing part 30 which is embodied as a fitting structure or fitting plate. A pump chamber 50 which is formed between the first and second housing parts 20, 30 is surrounded and/or defined on its circumferential side by an inner circumferential surface of a contour ring 2 which forms an inner contour. The first housing part 20, the second housing part 30 and the contour ring 2 are positioned with respect to each other in relation to their angular position around the rotational axis D by means of pin-shaped positioning elements 6. The at least one pin-shaped positioning element 6 is anchored in a bore of the second housing part 30. The positioning element 6 can for example be pressed, screwed, soldered, welded or glued into the second housing part 30. The contour ring 2 and the first housing part 20 each comprise passages through which the positioning element 6 extends. This enables the first and second housing parts 20, 30 and the contour ring 2 to be positioned and/or angularly positioned in relation to each other around the rotational axis D. The housing parts 2, 20, 30 can also be held together by means of the positioning elements 6 in order to be able to handle them as a unit and/or as a pump insert 1.

A spring 5 which is arranged between the end-facing wall 103 of the accommodating housing 100, which defines the accommodating space 102 on its end-facing side, and the first housing part 20 presses and/or tenses the first housing part 20 against the contour ring 2 and preferably in turn presses and/or tenses the contour ring 2 against the second housing part 30 when the pump insert 1 is inserted into the accommodating housing 100 and/or the accommodating space 102 of the accommodating housing 100. The spring 5 is supported on the end-facing wall 103 and on the first housing part 20 and exerts a force on the first housing part 20 which is directed away from the end-facing wall 103 and in particular points along the rotational axis D or the longitudinal direction of the positioning elements 6.

The spring 5 can for example be inserted, as a separate part, between the end-facing wall 103 and the pump insert 1 when the pump insert 1 is introduced into the accommodating space 102. In the example shown, however, the spring 5 is captively fastened to the pump insert 1, such that the spring 5 can be handled together with the pump insert 1 as a unit. It is therefore part of the pump insert 1. The spring 5 can for example be fastened to the pump insert 1 as is described in German patent application No. 10 2020 116 731.8.

In the example shown, a first pressure space and a second pressure space (not visible in the FIGURE) are formed between the end-facing wall 103 of the accommodating space 102 and the first housing part 20. The pump chamber 50 is connected to the first pressure space via a first outlet channel (not visible in the FIGURE) and to the second pressure space via a second outlet channel (not visible in the FIGURE). The pump shown is thus a dual-flux pump, i.e. the pump generates a first working flux, which is outputted from the pump chamber 50 into the first pressure space, and a second working flux which is outputted from the pump chamber 50 into the second pressure space. The first pressure space and the second pressure space are sealed off in relation to each other. This enables different fluid consumers or different supply branches to a common fluid consumer to be supplied with fluid. Optionally, this also enables different pressure levels to be generated in the first and second pressure spaces.

The first pressure space is surrounded and/or enclosed by a sealing element arranged between the end-facing wall 103 of the accommodating space 102 and the first housing part 20. The sealing element rests against the first housing part 20 and the end-facing wall 103 in a seal.

The second pressure space is surrounded and/or enclosed by a sealing element arranged between the end-facing wall 103 and the first housing part 20. This sealing element rests against the first housing part 20 and the end-facing wall 103 in a seal.

In the example shown, the first pressure space and the second pressure space are sealed off by a common sealing element 40, in particular a so-called bead gasket. In principle, however, separate sealing elements can also be provided for the first and second pressure spaces, or the seal can be achieved in a different way.

Advantageously, the sealing element 40 can be captively fastened to the positioning elements 6 and/or to the pump insert 1, for example by means of stud-bolts which are screwed into an internal thread of the positioning elements 6. The sealing element 40 can for example be embodied as is described in German patent applications 10 2019 132 729.6 and 10 2020 116 731.8, each incorporated herein by reference.

A suction space 101 which is formed between an inner circumferential wall 104 of the accommodating space 102 and the housing insert 1, in particular the contour ring 2, extends annularly around the pump insert 1 and/or the contour ring 2. The pump is adapted to deliver fluid from the suction space into the first pressure space via a first suction channel (not visible in the FIGURE), the pump chamber 50 (in particular, a first delivery chamber formed in the pump chamber) and the first outlet channel (the first working flux). The pump is also adapted to deliver fluid from the suction space 101 into the second pressure space via a second suction channel (not visible in the FIGURE), the pump chamber 50 (in particular a second delivery chamber formed in the pump chamber (50) and the second outlet channel (the second working flux).

The suction space 101 is arranged between a first sealing ring 8 and a second sealing ring 7. The sealing ring 8 is arranged between the circumferential wall 104 of the accommodating space 102 and the first housing part 20. The first housing part 20 comprises an annular groove which encircles the outer circumference of the first housing part 20 and in which the sealing ring 8 is arranged. The sealing ring 8 rests against the inner circumferential wall 104 and the first housing part 20, in particular the base of the annular groove, in a seal. The sealing ring 7 is arranged between the inner circumferential wall 104 and the second housing part 30. The sealing ring 7 is arranged in an annular groove which encircles the outer circumference of the second housing part 30. The sealing ring 7 rests against the inner circumferential wall 104 and the second housing part 30, in particular the base of the annular groove, in a seal.

A drive shaft 10 (pump shaft) is mounted, such that it can rotate about the rotational axis D, on the first housing part 20 by means of a first rotary bearing 22 which is embodied as a slide bearing, in particular in a blind hole or a blind bore, and on the second housing part 30 by means of a second rotary bearing 32 which is embodied as a slide bearing. A rotor 4 which is arranged together with delivery elements 3 in the pump chamber 50 is connected and/or joined to the drive shaft 10, such that it is rotationally fixed about the rotational axis D, by means of a shaft-hub connection 14, such that the rotor 4 rotates together with the drive shaft 10 during operation. The rotor 4 comprises guide slots in which the delivery members 3, which are embodied as vanes, are arranged. During operation, the delivery elements 3 slide along an inner contour and/or inner circumferential surface of the contour ring 2. Since the pump is embodied as a dual-flux and/or dual-stroke pump, the inner contour is embodied such that the vanes 3 extend out of the slot-shaped guides twice and retract into the slot-shaped recesses twice during one complete revolution of the rotor 4.

The drive shaft 10 comprises a passage 11 which in particular acts as a pressure relief channel. As an alternative to the embodiment described in the FIGURE, the passage which acts as a pressure relief channel can be embodied differently, for example in that the first housing part 20, the contour ring 2 and/or the positioning element 6 and the second housing part 30 form the passage. The passage 11 comprises a first opening 12 at the first end of the drive shaft 10, which is the end arranged in the first housing part 20, in particular the blind hole, and a second opening 13 at the second end of the drive shaft 10. The first rotary bearing 22 is arranged between the pump chamber 50 and the first opening 12 and/or a hollow space 21. The hollow space 21 is formed between the base of the blind bore, which lies opposite the first end of the drive shaft 10, and the first end of the drive shaft 10. The first opening 12 of the passage 11 emerges into the hollow space 21. Furthermore, the second opening 13 of the passage 11 emerges onto the side of the second housing part 30 which faces away from the pump chamber 50. This arrangement means that pressure fluid from the pump chamber 50, which for example flows as so-called leakage fluid into the hollow space 21 via the first rotary bearing 22, is drained via the passage 11, for example into a relief space 55 which is indicated in the FIGURE by a double-dot-dashed line and for example enclosed by a gearbox housing which in particular also forms the accommodating housing 100. This means that pressure, which can exert an axial thrust on the drive shaft 15, cannot accumulate in the hollow space 21. If the passage 11 were not provided, there would be a risk of pressure accumulating in the hollow space 21 which would exert an axial thrust on the drive shaft 15, leading to increased friction, increased wear and decreased efficiency of the pump. The passage 11 thus decreases wear and friction and increases efficiency. The second end of the drive shaft 10 is arranged in the relief space 55. The drive shaft 10 comprises a connecting structure 15 on the side of the second housing part 30 which faces away from the pump chamber 50. The connecting structure 15 is adapted to be connected to a hub of a drive element (not shown in the FIGURE). The drive element can be a gear wheel, a pinion, a belt disc or a gear element of for example a planetary gear system, such as for example a planetary carrier. The hub forms a shaft-hub connection with the connecting structure 15. The drive element can be coupled to a gear shaft of the gearbox, such that rotating the gear shaft causes the drive shaft of the pump to rotate.

The hub, in particular the drive element, can be arranged in the relief space 55. The relief space 55 is arranged on the side of the second housing part 30 which faces away from the pump chamber 50. The relief space 55 can be connected, for example by means of a channel, to a reservoir or alternatively to the suction side, in particular the suction space 101 of the pump, in order to feed fluid back from the relief space 55. Alternatively or additionally, fluid drained into the relief space can be drained into the reservoir by means of gravity, for example by placing the reservoir, for example an oil sump, lower in relation to the direction of gravity than the second opening and connecting the second opening 13 and the reservoir in fluid communication.

Preferably, atmospheric pressure prevails in the relief space 55, in particular in the space enclosed by the gear housing. The passage 11 also ensures that the same pressure or at least substantially the same pressure prevails in the intermediate space 21 as in the relief space 55, i.e. preferably atmospheric pressure.

A shaft gasket 33, in particular a radial shaft sealing ring, which is accommodated in or on the second housing part 30 rests against the drive shaft 10 in a seal. The shaft gasket 33 is arranged between the second rotary bearing 32 and the connecting structure 15. Alternatively or additionally, the second rotary bearing 32 is arranged between the pump chamber 50 and the shaft gasket 33.

In developments of the embodiment shown in the FIGURE, one or more transverse bores, i.e. bores which are arranged transversely with respect to the longitudinal direction of the passage 11 or the rotational axis D, can be provided in the drive shaft 10. A transverse bore can for example be provided in the region of the shaft-hub connection 14. The transverse bore emerges into the shaft-hub connection 14 and into the passage 11. Thus, depending on the pressure conditions, a leakage fluid flow from the pump chamber 50 into the passage 11 via the shaft-hub connection 14 and the transverse bore and from the passage 11 into the relief space 55 can be generated, thus enabling fretting and wear in the shaft-hub connection to be decreased or prevented. Depending on the pressure conditions, leakage fluid can alternatively be moved through said transverse bore from the intermediate space 21 onto the shaft-hub connection 14 via the passage 11 and the transverse bore.

Alternatively or additionally, a transverse bore which emerges onto the outer circumference of the drive shaft 10 and onto the passage 11 can be provided between the pump chamber 50 and the shaft gasket 33. The transverse bore can emerge into a region on the outer circumference which is arranged between the second rotary bearing 32 and the point at which the shaft gasket 33 rests against the drive shaft 10 in a seal. This can mean that on the one hand, the shaft gasket 33 is relieved of pressure, and on the other hand, the throughput of leakage fluid from the pump chamber 50 through the second rotary bearing 32 is increased, thus enabling the second rotary bearing 32 to be better lubricated and/or cooled. The flow of leakage fluid through the first rotary bearing 22 also lubricates and/or cools the first rotary bearing 22.

Alternatively or additionally, a transverse bore can be provided in the region of the connecting structure 15, wherein the transverse bore emerges into the connecting structure 15 and into the passage 11. This can mean that leakage fluid drained through the passage 11 is moved onto the connecting structure 15 via the transverse bore and thus onto the shaft-hub connection between the hub of the drive element and the connecting structure 15. This decreases or even prevents wear and/or fretting on the connecting structure and/or the shaft-hub connection.

The second housing part 30 is embodied such that the pump insert 1 can be fastened to the accommodating housing 100. The second housing part 30 comprises a fastening flange 31 which comprises one or more bores in order to enable the second housing part 30 to be fastened to the accommodating housing 100 by means of stud-bolts. In the example shown, the longitudinal direction of the bores in the fastening flange 31 is parallel to the rotational axis D. The fastening flange 31 can be clamped between a head of the stud-bolt screwed into the accommodating housing 100 and the accommodating housing 100.

The first housing part 20 optionally comprises a journal 23 which protrudes from the end-facing surface of the first housing part 20 which faces away from the pump chamber 50 and/or faces the end-facing wall 103. The journal 23 can serve to center the sealing element 40. Alternatively or additionally, the journal 23 can serve to center the pump insert 1 or the first housing part 20 on the accommodating housing 100. The accommodating housing 100 can comprise a bore having an inner circumferential surface on which the outer circumferential surface of the journal 23 is centered.

The accommodating housing 100 can also comprise a channel which emerges into the first pressure space and via which the first working flux can flow off to the consumer. The accommodating housing can also comprise a channel which emerges into the second pressure space and via which the second working flux can flow off to the corresponding fluid consumer.

The rotor 4 and the connecting structure 15 are joined such that they are translationally fixed with respect to each other along the rotational axis D, for example by means of a securing element 16 which can for example be embodied as an axial shaft securing ring which is fitted onto the drive shaft. The rotor 4 can be arranged and/or enclosed between a stage of the drive shaft 10 and the securing element 16 which is fastened on the drive shaft 10.

LIST OF REFERENCE SIGNS

1 pump insert
2 contour ring
3 delivery element/vane
4 rotor
5 spring
6 positioning element
7 (first) sealing element/sealing ring
8 (second) sealing element/sealing ring
9 fastening element
10 drive shaft
11 passage/bore/pressure relief channel
12 (first) opening
13 (second) opening
14 shaft-hub connection
15 connecting structure
16 securing element
20 first housing part/pressure plate
21 hollow space
22 first rotary bearing
23 journal
24 base of a blind hole
30 second housing part/fitting plate
31 fastening flange
32 second rotary bearing
33 shaft gasket
40 sealing element/bead gasket
50 pump chamber
55 relief space/environment
100 accommodating housing
101 suction space
102 accommodating space
103 end-facing wall
104 inner circumferential wall
D rotational axis

The invention claimed is:

1. A pump comprising a pump insert adapted to be inserted into an accommodating housing, the pump insert comprising:

a drive shaft comprising a rotor;

a first housing part and a second housing part, between which a pump chamber is formed, in which the rotor is arranged; and a rotary bearing via which the drive shaft is mounted on the first housing part such that it can rotate about its rotational axis;

wherein the drive shaft comprises a passage, a first opening forming a first end of the passage, and a second opening forming a second end of the passage, wherein the rotary bearing is arranged between the pump chamber and the first opening, and the second opening of the passage opens onto the side of the second housing part which faces away from the pump chamber, and wherein the second housing part comprises a fastening flange adapted to fasten the second housing part to the accommodating housing;

the pump insert further comprising a hollow space which is formed between a base of a blind hole formed by the first housing part and a first end of a drive shaft which is arranged in the first housing part, wherein the first opening of the passage emerges into the hollow space.

2. The pump according to claim 1, wherein the second housing part is a fitting plate.

3. The pump according to claim 1, wherein the rotary bearing is arranged between the pump chamber and the hollow space.

4. The pump according to claim 1, wherein the second opening emerges into the environment of the pump or the pump insert.

5. The pump according to claim 4, wherein the environment is outside an accommodating space of the accommodating housing in which the pump insert is accommodated.

6. The pump according to claim 1, wherein the pump is a multi-stroke pump or a dual-stroke pump.

7. The pump according to claim 1, wherein the pump is a multi-flux pump or a dual-flux pump.

8. The pump according to claim 1, further comprising a first pressure space and a second pressure space, wherein the pump chamber is connected to the first pressure space via a first outlet channel and to the second pressure space via a second outlet channel, wherein the first pressure space and the second pressure space are sealed off in relation to each other.

9. The pump according to claim 8, wherein at least one of the first pressure space and the second pressure space is formed between an end-facing wall of an accommodating space and the first housing part.

10. The pump according to claim 8, wherein a suction space is formed between a circumferential wall of the accommodating space formed by the accommodating housing and the pump insert or a contour ring.

11. The pump according to claim 1, further comprising a second rotary bearing, via which the drive shaft is mounted on the second housing part such that it can rotate about its rotational axis, and a shaft gasket, wherein the second rotary bearing is arranged between the shaft gasket and the pump chamber.

12. The pump according to claim 1, wherein the drive shaft together with the rotor, and the first housing part and second housing part, are components of the pump insert which is inserted or adapted to be inserted as a unit into an accommodating space formed by the accommodating housing.

13. A gearbox comprising a gear housing and a gear shaft which is connected via a drive element to the drive shaft of the pump according to claim 1, such that rotating the gear shaft causes the drive shaft to rotate, wherein the gear housing encloses the relief space and/or forms an accommodating space.

14. The gearbox according to claim 13, wherein the pump insert is arranged in the accommodating space, wherein the accommodating space is sealed off in relation to the environment or a relief space.

15. A pump comprising a pump insert adapted to be inserted into an accommodating housing, the pump insert comprising:

a drive shaft comprising a rotor;

a first housing part and a second housing part, between which a pump chamber is formed, in which the rotor is arranged; and a rotary bearing via which the drive shaft is mounted on the first housing part such that it can rotate about its rotational axis;

wherein the drive shaft comprises a passage, a first opening forming a first end of the passage, and a second opening forming a second end of the passage, wherein the rotary bearing is arranged between the pump chamber and the first opening, and the second opening of the passage opens onto the side of the second housing part which faces away from the pump chamber, wherein the second housing part comprises a fastening flange adapted to fasten the second housing part to the accommodating housing, wherein the drive shaft comprises a connecting structure, which is adapted to be connected to a hub, on the side of the second housing part which faces away from the pump chamber, wherein an environment of the pump or pump insert or a relief space is formed on the side of the second housing part which faces away from the pump chamber, wherein the environment or the relief space is adapted to accommodate the hub to which the connecting structure is connectable, wherein the second opening of the passage emerges into the environment or the relief space, and wherein the relief space is connected to a reservoir or to the suction side or to a suction space of the pump, in order to feed fluid back from the relief space.

16. The pump according to claim 15, wherein the relief space is connected to the atmosphere, such that atmospheric pressure prevails in the relief space while the pump is in operation.

* * * * *